US005363118A

United States Patent [19]

Okumura

[11] Patent Number: 5,363,118

[45] Date of Patent: Nov. 8, 1994

[54] DRIVER INTEGRATED CIRCUITS FOR ACTIVE MATRIX TYPE LIQUID CRYSTAL DISPLAYS AND DRIVING METHOD THEREOF

[75] Inventor: Fujio Okumura, Tokyo, Japan

[73] Assignee: NEC Corporation, Tokyo, Japan

[21] Appl. No.: 956,963

[22] Filed: Oct. 6, 1992

[30] Foreign Application Priority Data

Oct. 7, 1991 [JP] Japan ..... 3-258994

[51] Int. Cl.[5] ..... G09G 3/36

[52] U.S. Cl. ..... 345/95; 345/89; 345/211

[58] Field of Search ..... 340/793, 784, 767, 765, 340/811, 812, 813, 814; 345/89, 87, 98, 99, 100, 92, 91, 147, 148, 211, 212, 213, 95

[56] References Cited

U.S. PATENT DOCUMENTS

| | | | |
|---|---|---|---|
| 4,766,430 | 8/1988 | Gillette et al. | 340/793 |
| 5,061,920 | 10/1991 | Nelson | 340/793 |
| 5,122,792 | 6/1992 | Stewart | 340/793 |
| 5,162,786 | 11/1992 | Fukuda | 340/793 |
| 5,196,738 | 3/1993 | Takahara et al. | 340/793 |

OTHER PUBLICATIONS

"13.1: A 1 Mega-Pixel Color a-Si TFT Liquid-Crystal Display", *SID 88 Digest,* 1988, by D. Castleberry et al., pp. 232–235.

"27.4: CMOS Driver LSIs for Megapixel Multi-Color TFT-LCDs", *SID 91 Digest,* 1991, by K. Hyugaji et al., pp. 543–546.

*Primary Examiner*—Ulysses Weldon
*Assistant Examiner*—Xiao M. Wu
*Attorney, Agent, or Firm*—Young & Thompson

[57] ABSTRACT

Provided is a novel multi-level driver system for driving active matrix circuits accommodated in liquid crystal display devices. The novel driver circuit structure permits a high gray level display without a substantial enlargement of the circuit scales and the number of external voltage supplies. The voltage levels supplied by the external voltage supplies are varied during writing performance of the voltage level. Logic circuits fetches digital data from a latch circuit and select any one of plural timing control signals. An analog switch is operated by output signals from the logic circuits. The variable voltage level is transmitted through the analog circuit to each pixel capacitor. The timing control of the switching performance determines resultant voltage level to be stored in the pixel capacitor. The gray levels are associated with the total number of voltage levels. The number of gray levels is equivalent to the number of the external voltage supplies multiplied by the number of variable voltage levels controlled by the switching performance of the analog switch.

12 Claims, 5 Drawing Sheets

DRIVER INTEGRATED CIRCUITS FOR ACTIVE MATRIX TYPE LIQUID CRYSTAL DISPLAYS AND DRIVING METHOD THEREOF

BACKGROUND OF THE INVENTION

The invention relates to driver integrated circuits for driving active matrix circuits accommodated in liquid crystal display devices, and more particularly to such circuits using a multi-level driver system.

Active matrix type liquid crystal displays are well known in the art. Such display device essentially comprises active matrix circuits, driver integrated circuits and power supply circuits. In the prior art, a sample-and-hold circuit system which includes sample-and-hold circuits and buffers has been used as a driving system for such display device. The sample-and-hold circuit system uses only analog signals as data which is unsuitable for a high speed performance of the display device as compared with digital signals. The analog signals exhibit a fluctuation of a voltage which affects device performances. Further, the sample-and-hold circuit system requires a reset operation.

To combat those disadvantages, a multi-level driver system which uses only digital signals as data was proposed. The multi-level driver system has a plurality of power supplies, each of which supplies a predetermined voltage to the active matrix circuits thereby permitting any one of plural different voltage levels to be selected.

The prior art of such multi-level driver system will now be described with reference to FIG. 1. Equivalent circuits to the active matrix circuits accommodated in the liquid crystal display device essentially comprises gate lines 301 serving as scanning lines, drain lines 303 serving as voltage signal transmission lines, thin film transistors 307 serving as switching devices and pixel capacitors 306 having opposite electrodes 308 which store the voltage signals. Both the pixel capacitors 306 and the thin film transistors 307 are aligned in a matrix. To drive the active matrix circuits, the liquid crystal display device accommodates a plurality of drain line driver integrated circuits 304 connected to the drain lines 303 and a plurality of gate line driver integrated circuits 302 connected to the gate lines 301. Further, a power supply circuit 305 generates a plurality of predetermined voltage levels. The drain line driver integrated circuits 304 are connected in series to the power supply circuit 305.

Each of the drain line driver integrated circuits 304 selects any one of various voltage levels supplied from the power supply circuit 305 and transmits the selected level voltage as voltage signals to the drain lines 303. Concurrently, each of the gate line driver integrated circuits 302 applies voltage pulses to the gate lines 301 to accomplish the scanning of the display. As a result of the scanning, thin film transistors 307 which are applied with the voltage pulse are taken into ON state. Then, the voltage signals applied to the drain line 303 are transmitted through the thin film transistor 307 to the pixel capacitor 306, after which thin film transistor 307 turns OFF to store the voltage signal in the pixel capacitor 306. This results in an accomplishment of write operations to the active matrix circuits. Generally, the gray level of each of plural pixels involved in the display devise is associated with the voltage level stored in the pixel capacitor.

Circuit performances of the drain line driver integrated circuits 304 are described with reference to FIG. 2. Any one of the above plural drain line driver circuits 304 is selected by a chip selector circuit 401 which is controlled by grouped control signals 402. A shift register 403 is applied with a clock signal 404. The shift register 403 is controlled by the chip selector circuit 401 and the grouped control signals 402 to generate scanning pulses by which a data transmission shift register 405 is scanned. The data transmission shift register 405 stores digital signals of the gray levels of the pixels. Normally, digital signals of colors are based so that digital signals of red, green and blue colors are allocated in a column. This requires a signal input timing to be controlled by the shift register 403. If a monochrome display is accomplished, the shift register 403 may be omitted. A latch circuit 407 fetches and reads concurrently the digital signals allocated on a line from the data transmission shift register 405 in which a latch timing is controlled by signals transmitted through a signal line 408. The latch circuit 407 outputs the above digital signals which have been fetched and concurrently fetches digital signals allocated on a next line from the data transmission shift register 405. A multi-level driver 409 is connected to plural power supplies 305 through power transmission lines 410. The multi-level driver 409 receives digital signals from the latch circuit 407, after which the multi-level driver 409 selects any one of plural power transmission lines 410 connected to the power supplies 305. The voltage signals supplied from the selected power supply are transmitted through output terminals 411 to the drain lines 303.

The operations of the multi-level driver 409 in case of eight gray levels will subsequently be described with reference to FIG. 3. In this case, digital signals comprising three bits are required for each pixel to accomplish the eight gray level display. A latch circuit 501 stores digital data D1, D2 and D3. An address decoder 502 fetches the digital data D1, D2 and D3 followed by decoding the digital data. Subsequently, the address decoder 502 outputs selective signals to selective signal lines 505. The selective signals serve to operate a plurality of analog switches 504, and thus any one of the analog switches 504 turns ON thereby selecting any one of voltage levels V0 to V7 supplied from the plural power supplies 503. Thus, the selected voltage level is transmitted as a voltage signal through the selected analog switch 504 to a voltage signal transmission line. The voltage signal is further transmitted to the active matrix circuits through an analog switch 506 which is controlled by gate pulse applied to a gate terminal 507.

When any one of the voltage levels is selected and outputted as the voltage signal, the analog switch 506 turns ON by gate pulses applied to the gate terminal 507 so that the voltage signal supplied from the external voltage supply 503 is transmitted to a thin film transistor 508 through the drain line 303 involved in the active matrix circuits. The thin film transistor 508 serves as a switching device in the active matrix circuits and controlled by a gate pulse applied to a gate terminal 509. The gate line driver integrated circuits 302 apply voltage pulses to the gate lines 301 whereby the thin film transistors 508 are taken into ON state. Subsequently, the voltage signal is transmitted through the thin film transistor 508 serving as the analog switch to a pixel capacitor 510. The pixel capacitor 510 including an opposite electrode 511 stores the voltage signal of any of voltage levels V0 to V7. Since the gray levels of the pixel are associated with the voltage levels V0 to V7 stored in the pixel capacitor 510, the number of gray levels corresponds to the number of the voltage levels, and thus to the number of power supplies. In this case, since eight voltage levels V0 to V7 exist, the display of eight gray levels is thus accomplished.

In the prior art, the accomplishment of a high gray level display requires a large number of power supplies which correspond to the number of gray levels. The number of power supplies defines the number of gray levels in this multi-level driver system. By the way, the sample-and-hold circuit system permits infinite gray levels in view of idealization. Generally, the driver integrated circuits of the multi-level driver system accommodate a large number of signal lines, typically 120 to 200 output lines. Such display devices are likely to limit the gray levels to eight gray levels. In the prior art, the accomplishment of a high gray level display renders such display device unreasonable. For instance, the accomplishment of the sixteen gray level display renders the circuit scale twice approximately, much less the thirty two or sixty four gray level displays are of no utility in view of circumstances. Further, the gray levels of the multi-level driver system correspond to the voltage levels stored in the pixel capacitor. The accomplishment of a large number of gray levels requires a large number of voltage levels. Thus, such high gray level display device is also required to accommodate a large number of power circuits thereby causing a higher cost and a high power consumption.

SUMMARY OF THE INVENTION

Accordingly, it is a primary object of the present invention to provide a novel driver circuit structure for driving active matrix circuits accommodated in a liquid crystal display, which is operated in a multi-level driver system.

It is a further object of the present invention to provide a novel driving method of active matrix circuits, which permits a high gray level display of liquid crystal displays without a substantial enlargement of the circuit scales.

The above and other objects, features and advantages of the present invention will be apparent from the following descriptions.

In accordance with the present invention, a novel multi-level driver circuit structure permits a high gray level display without a substantial enlargement of the circuit scales. A latch circuit stores plural digital data, a part of which is allocated to an address decoder and remaining digital data is allocated to a timing control feature. The address decoder is connected to the latch circuit to fetch the partial digital data. According to the partial data, the address decoder selects any one of plural external power supplies, each of which supplies a predetermined voltage level, by operating analog switches.

The voltage levels supplied from the external voltage supplies are varied in a predetermined range without being across adjacent voltage levels. The variable voltage level which is selected by the address decoder is transmitted as voltage signals to a voltage signal transmission line through the analog switches. Then, the voltage level on the voltage signal transmission line are also varied. The voltage signal is further transmitted through an analog switch to the active matrix circuits. The voltage level to be inputted into the active matrix circuits depends upon the off timing of the analog switches.

The novel driver circuit structure has a timing control feature which comprises logic circuits and the above analog switches. The logic circuits fetch the remaining digital data stored in the latch circuit, in addition receives plural timing control signals. The logic circuits select any one of the plural timing control signals according to the fetched digital data and output the selected timing control signal to the analog switch. The analog switch is operated by the selected timing control signal. The voltage level when the analog switch turns OFF is stored in the pixel capacitor. The gray levels of the pixel are associated with the voltage level controlled by the off timing of the analog switch. The number of gray levels is equivalent to the number of the external voltage supplies multiplied by the number of variable voltage levels. Therefore, the novel multi-level driver system permits a high gray level display to be realized without a substantial enlargement of the circuit scales.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

Figure 1:
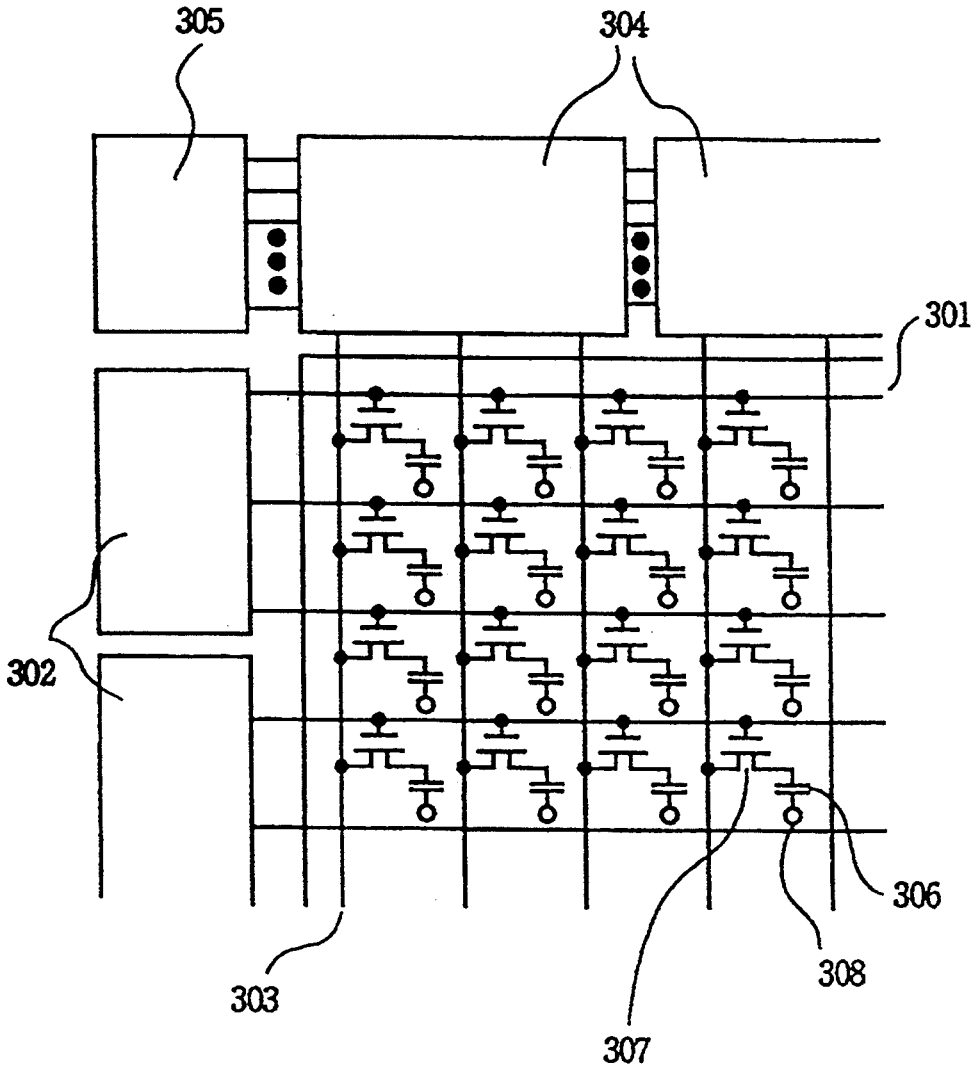
FIG. 1 PRIOR ART
FIG. 1 is a circuit diagram illustrative of a liquid crystal display device including active matrix circuits and driver circuits in the prior art.
Figure 2:
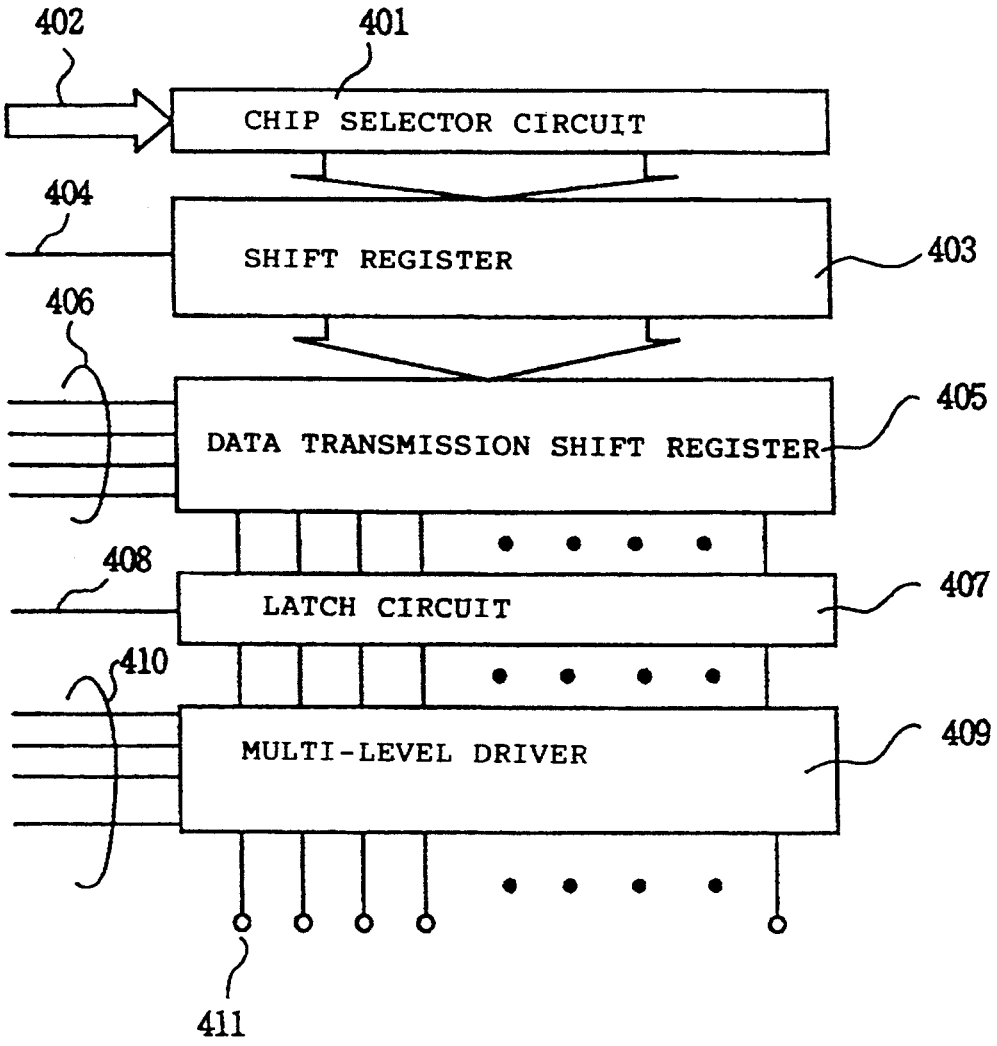
FIG. 2 PRIOR ART
FIG. 2 is a block diagram illustrative of driver circuit structures for driving active matrix circuits accommodated in the liquid crystal displays in the prior art.
Figure 3:
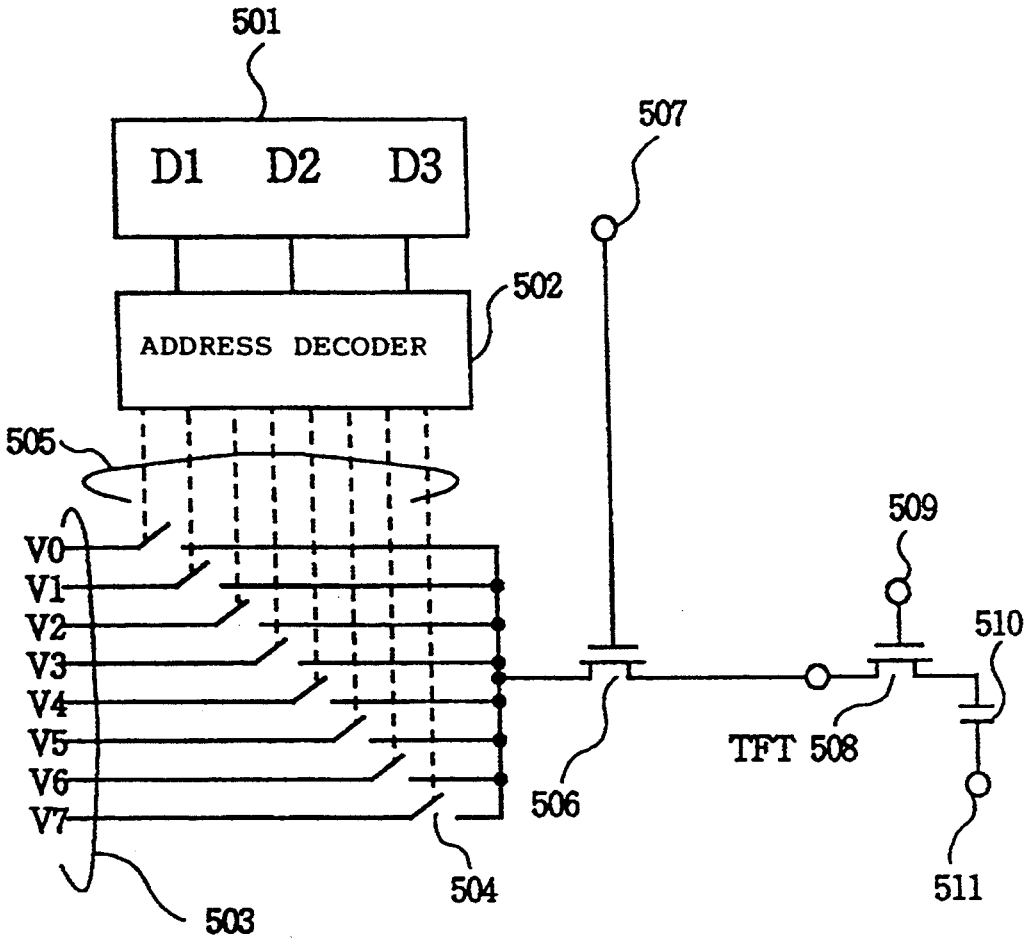
FIG. 3 PRIOR ART
FIG. 3 is a circuit diagram illustrative of a circuit structure of multi-level driver circuits and active matrix circuits, both of which are required for each of plural pixels accommodated in liquid crystal displays in the prior art.
Figure 4:
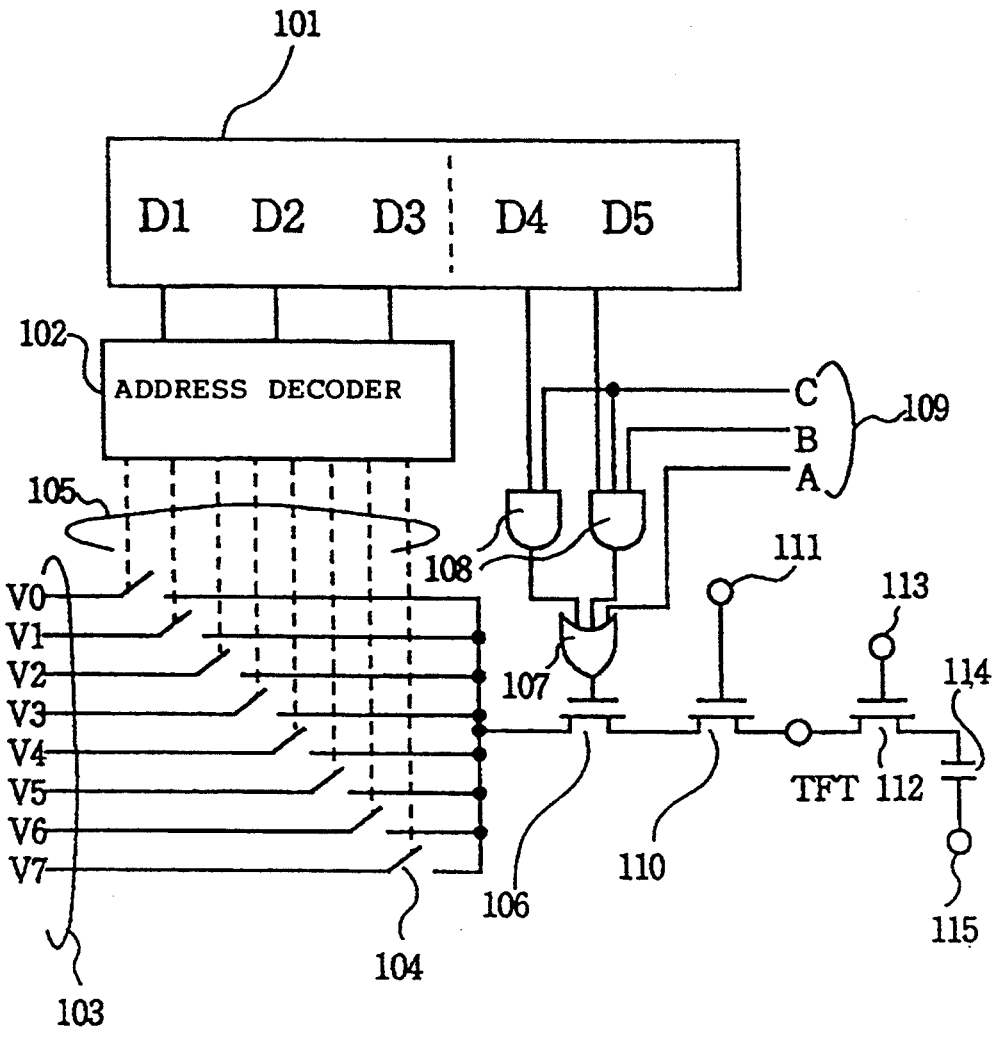
FIG. 4 is a circuit diagram illustrative of a novel circuit structure of multi-level driver circuits and active matrix circuits, both of which are required for each of plural pixels accommodated in liquid crystal displays of one embodiment according to the present invention.

A novel structure of driver integrated circuits for driving active matrix circuits involved in a liquid crystal display device accomplishes a high gray level display, for instance a thirty two gray level display. For convenience, a partial circuit structure which is required for each of plural drain lines will be described with referring to FIG. 4. A latch circuit 101 which is required for one pixel involved in the liquid crystal display stores five bit digital signals D1, D2, D3, D4 and D5 in order to accomplish the thirty two gray level display.

An address decoder 102 fetches and decodes the digital signals D1, D2 and D3 to select any one of a plurality of voltage levels. The address decoder 102 is connected to eight selective signal lines 105 which are connected to external power supplies 103 through analog switches 104. The address decoder decodes the digital signals D1, D2 and D3 and outputs selective digital signals to plural selective signal transmission lines 105, each of which is connected to an analog switch 104. The selective digital signals operate the analog switch 104 so as to select any one of external voltage supplies, each of which supplies a predetermined voltage level. The plural external voltage supplies are connected to the analog switches through voltage signal transmission lines 103. The digital signals D1, D2 and D3 stored in the latch circuit 101 permit selecting any one of voltage levels V0 to V7. Then, the selected voltage level is transmitted as voltage signals to an analog switch 104 through the voltage signal transmission line. The voltage level is further transmitted through the voltage signal transmission line to an analog switch 106. After that, the voltage signals are also transmitted into the active matrix circuits through an analog switch 110 having a gate electrode 111. The analog switch 110 may be omitted by matching the requirement.

The active matrix circuit essentially comprises plural thin film transistors 112 and corresponding plural pixel capacitors 114, both of which are aligned in a matrix through drain and gate lines. The thin film transistor 112 has a gate electrode 113. The pixel capacitor 114 has an opposite electrode 115. The selected voltage level, or the voltage signal is transmitted to the pixel capacitor 114 through the thin film transistor 112, followed by storing the voltage signal in the pixel capacitor 114. The voltage level stored in the pixel capacitor 114 determines the gray level of the pixel. The above driver performances are analogous to the prior art.

The remaining digital data D4 and D5 which are stored in the latch circuit 101 are respectively transmitted to logic circuits. The logic circuits comprise two AND gates 108 and one OR gate 107. The logic circuits are connected to plural timing control signal transmission lines 109. In this case, timing control signals A, B and C are respectively applied to the logic circuits. The logic circuits comprising the AND gates and the OR gate receive the timing control signals A, B and C and concurrently fetch the digital data D4 and D5. One of the AND gates 108 fetches the digital data D4 and receives the timing control signal C. Another AND gate 108 fetches the digital data D5 and receives the timing control signals B and C. The OR gate 107 fetches both outputs signals from the AND gates 108 and receives the timing control signal A. The OR gate 107 outputs digital signal to the gate terminal of the analog switch 106. The analog switch 106 is operated by the output signal from the logic circuits.

Figure 5:
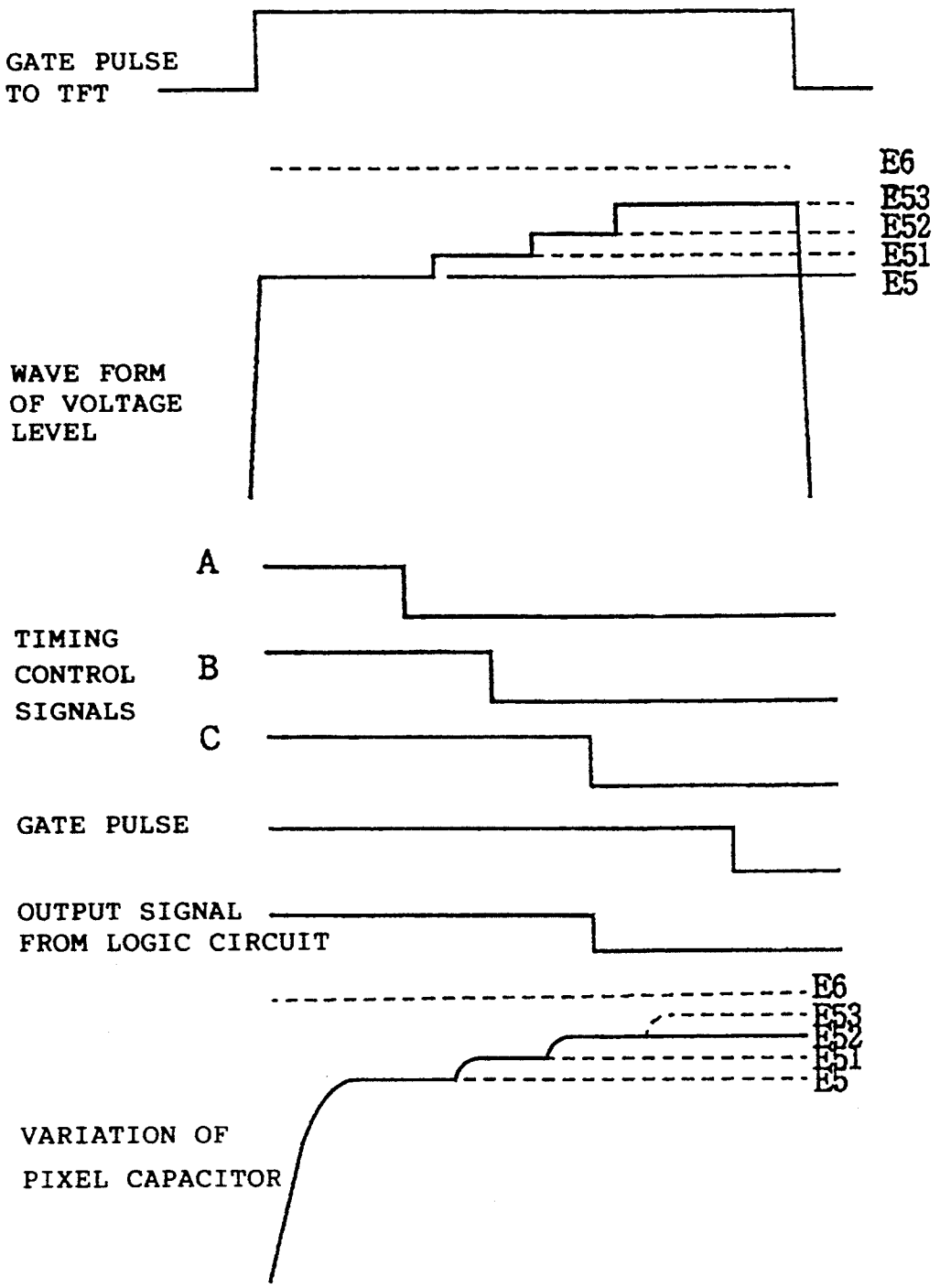
FIG. 5 is a diagram illustrative of a timing chart associated with a driving performance of the multi-level driver circuits of FIG. 4.

The operations of the driver circuit will subsequently be described with reference to FIG. 5. In this case, the digital signals D1 to D5 are binary signals "10110". Since the three bits to be allocated to the address decoder 102 are "101", a voltage level V5 is selected. The gate electrode 113 of the thin film transistor 122 is applied with a gate pulse as shown in FIG. 5. When the gate pulse is in a high level, the transistor 112 is in the ON state, or write enable state. The wave form of the voltage signal V5 is shown in FIG. 5. The voltage level V5 is gradually increased to form a terraced wave form, each of which is labeled by E5, E51, E52 or E53. The gray level corresponds to the each voltage level. Since the liquid crystal display has a non-linear voltage-transmittance characteristic, the intervals of the increase of the voltage level V5 is not always constant. The timing control signal lines 109 are applied with the timing control signals A, B and C having wave forms as shown in FIG. 5. The digital signals D4 and D5 are "1" and "0" respectively. Then, the logic circuits comprising the AND gates 108 and the OR gate 107 outputs a gate pulse having the same wave form as the timing control signal C to the analog switch 106. When the timing control signal C becomes the low level, the analog switch 106 turns OFF. The gate electrode 111 of the analog switch 110 is applied with a gate pulse as shown in FIG. 5 in which the analog switch 110 is in ON state during the high level. Then, a potential of the pixel capacitance 114 is increased up to E52 during the high level of the timing control signal C. The voltage level E52, when the analog switch 106 turns OFF, remains in the pixel capacitor 114. The voltage level to be stored in the pixel capacitor 114 is defined by the off timing of the analog switch 106. Thus, the timing control of the switching performance of the analog circuit 106 permits a desired voltage level to be written in the pixel capacitor thereby realizing a desired gray level of the pixel. As shown in FIG. 5, the wave form showing the variation of the potential has a lull caused by the delay of the signal transmission through the gate lines and the time constant produced by the thin film transistor 112 and the pixel capacitor 114.

The digital data D4 and D5 select any one of timing control signals A, B and C thereby the analog switch 106 is operated to turn OFF. The timing control of the off performance of the analog switch 106 determines any one of the voltage levels E5, E51, E52 and E53, followed by storing in the pixel capacitor 114. When the digital data D4 and D5 are "0" and "0" respectively, the voltage level E5 is selected. When the digital data D4 and D5 are "0" and "1" respectively, the voltage level E51 is selected. The pixel has a gray level corresponding to the selected voltage level. The novel multi-level driver operation of this embodiment permits the thirty two gray level display to be accomplished by the eight external power supplies 103.

While in the above embodiment the thirty two gray level display is accomplished, the number of the gray levels may readily be expanded by modifications of timing control signals and digital data to be allocated to the logic circuit. When digital signals of m-bits are allocated for each pixel, n-bit signals involved in the m-bit signals are allocated to the address recorder to select any one of $2^n$ power supplies. Remaining digital signals of (m-n) bits are allocated to the logic circuits to select any one of a plurality of timing control signals. The timing control of th off switching performance of the analog accomplished by the timing control signal determines any one of $2^{m-n}$ voltage levels, each of which is increased from the predetermined voltage supplied by the selected power supply. The number of gray levels is equivalent to $2^n$ of the external voltage supplies multiplied by $2^{m-n}$ of variable voltage levels controlled by the switching performance of the analog switch 106. Thus, the $2^m$ gray level display may be realized.

While in the above embodiment the wave form showing the variation of the voltage from the power supply is terraced, other wave forms such as sloped wave form may also be available. In replacement of the increase of the voltage level, the voltage level supplied from the power supply may be decreased. For example, it is possible to decrease the voltage level from V5 down to V4 either at predetermined intervals or continuously.

The novel driving method of driving the active matrix circuits permits a high gray level display to readily be accomplished without a substantial enlargement of a circuit scale. Although the driver circuits and power supply circuits are simplified, the high gray level display is accomplished.

Whereas modifications of the present invention will no doubt be apparent to a person of ordinary skilled in the art, it is to be understood that the embodiments shown and described by way of illustration are by no means intended to be considered in a limiting sense. Accordingly, it is to be intended by the claims to cover all modifications of the invention which fall within the spirit and scope of the invention.

What is claimed is:

1. A multi-level driver system for driving active matrix circuits in a liquid crystal display device comprising:

means for storing digital data;

means connected to said storing means for selecting any one of a plurality of voltage levels supplied from power supply circuits according to partial informations of said stored digital data, said selecting means being connected to said power supply circuits;

means provided in said power supply circuits for varying each of said plurality of voltage levels within a predetermined range between adjacent ones of said plurality of voltage levels to produce variable voltage levels from said power supply; and means connected to said storing means and to voltage signal transmission lines for selecting a desired variable voltage level to be stored in each pixel capacitor in said active matrix circuits according to both remaining digital data in said storing means and a plurality of timing control signals, said selecting means fetching said remaining digital data and receiving said timing control signals;

said remaining digital data selecting one of said plurality of timing control signals, said selected timing control signal in turn determining which of said variable voltage levels is to be stored in each pixel capacitor by actuating a switch means after a time interval associated with said desired variable voltage level.

2. The multi-level driver system as claimed in claim 1, wherein said varying means varies said plurality of voltage levels to produce variable voltage levels at predetermined intervals.

3. The multi-level driver system as claimed in claim 1, wherein said varying means varies said plural voltage levels continuously.

4. The multi-level driver system as claimed in claim 1, wherein said selecting means comprises logic circuits.

5. The multi-level driver system as claimed in claim 1, wherein said variable voltage levels are established solely by timing control of said at least one switching device, said timing control being performed by said determining means.

6. The multi-level driver system as claimed in claim 1, wherein said at least one switching device is an analog switch.

7. A driver integrated circuit structure for active matrix circuits in a liquid crystal display device operated in a multi-level driving system comprising:

a plurality of multi-level driver circuits provided for pixel capacitors in said active matrix circuits, each of said plurality of multi-level driver circuits comprising:

means for storing digital data;

means connected to said storing means for selecting any one of a plurality of voltage levels supplied from power supply circuits according to partial informations of said stored digital data, said selecting means being connected to said power supply circuits;

means provided in said power supply circuits for varying each of said plurality of voltage levels within a predetermined range between adjacent ones of said plurality of voltage levels to produce variable voltage levels from said power supply; and means connected to said storing means and to voltage signal transmission lines for selecting a desired variable voltage level to be stored in each pixel capacitor in said active matrix circuits according to both remaining digital data in said storing means and a plurality of timing control signals, said selecting means fetching said remaining digital data and receiving said timing control signals;

said remaining digital data selecting one of said plurality of timing control signals, said selected timing control signal in turn determining which of said variable voltage levels is to be stored in each pixel capacitor by actuating a switch means after a time interval associated with said desired variable voltage level.

8. The driver integrated circuit structure as claimed in claim 7, wherein said varying means varies said plural voltage levels at predetermined intervals.

9. The driver integrated circuit structure as claimed in claim 7, wherein said varying means varies said plural voltage levels continuously.

10. The driver integrated circuit structure as claimed in claim 7, wherein said selecting means comprises logic circuits.

11. The driver integrated circuit structure as claimed in claim 7, wherein said variable voltage levels are established solely by timing control of said at least one switching device, said timing control being performed by said determining means.

12. The driver integrated circuit structure as claimed in claim 7, wherein said at least one switching device is an analog switch.

* * * * *